US005133699A

United States Patent [19]

Cooper

[11] Patent Number: 5,133,699

[45] Date of Patent: Jul. 28, 1992

[54] PORTABLE MOTOR SKILL DEVELOPMENT LOW BEAM

[76] Inventor: Jesse F. Cooper, 3471 East 75th Place, Tulsa, Okla. 74136

[21] Appl. No.: 711,172

[22] Filed: Jun. 5, 1991

[51] Int. Cl.[5] ..... A63B 4/00

[52] U.S. Cl. ..... 482/34

[58] Field of Search ..... 272/111, 109, 62, 63, 272/69, 65; 138/157, 162, 163; 52/731; 174/101

[56] References Cited

U.S. PATENT DOCUMENTS

| | | | |
|---|---|---|---|
| 265,716 | 10/1882 | Taylor | 138/163 |
| 3,589,716 | 6/1969 | Footlik | 272/60 |
| 3,990,697 | 11/1976 | Feuther | 272/111 |
| 4,105,201 | 8/1978 | L'Ecuyer | 272/111 |
| 4,272,073 | 6/1981 | Grosser et al. | 272/111 |
| 4,448,411 | 5/1984 | Parker | 272/111 |

FOREIGN PATENT DOCUMENTS

| | | | |
|---|---|---|---|
| 0639563 | 2/1979 | U.S.S.R. | 272/62 |

*Primary Examiner*—Richard J. Apley
*Assistant Examiner*—Jerome Donnolly
*Attorney, Agent, or Firm*—Head and Johnson; PA.

[57] ABSTRACT

A portable motor skill development low beam formed of an elongated generally flat base having, on the upper surface, spaced apart, paralleled short vertical height ridges and an elongated beam member of generally inverted U-shaped cross-sectional configuration providing a top generally planar upper surface and integral, opposed, downwardly extending side portions each having a lower edge that rests upon the base member, the lower edges of the side portions being received by the base portion vertical ridges so that the beam member is supported on the base portion providing an upper surface for use by a gymnast, the beam member being easily detachable from the base member so that the device can be quickly disassembled for ease of transportation.

5 Claims, 2 Drawing Sheets

PORTABLE MOTOR SKILL DEVELOPMENT LOW BEAM

BACKGROUND OF THE INVENTION

A piece of equipment commonly employed by gymnasts for perfecting motor skill development, and more specifically for perfecting gymnastic skills, is called a "balance beam." The balance beam most commonly employed by gymnasts and of the type used in gymnastic competition is in the form of an elongated horizontal beam with a flat horizontal narrow and straight upper surface. The balance beam is supported at an elevation of approximately three feet, more or less, above a floor surface. The gymnast performs acts of skill on the narrow elongated horizontal upper surface. The apparatus is called a "balance beam" since it requires the gymnast to exercise a high degree of balance to stay atop the narrow horizontal beam surface.

The balance beam is an exceedingly effective apparatus for teaching motor skills, particularly to young students. Nearly all gymnastic activity, as well as athletic activity in general, requires a highly developed ability to maintain balance of the body. For this reason, a balance beam is a useful tool to develop young athletes, and particularly young gymnasts, and the skills learned on a balance beam provide useful development techniques whether or not the young students proceed to become a fully accomplished athletes or gymnasts.

There are two basic problems with the typical balance beam apparatus when used for young students. First is the fact that the typical balance beam is raised at a substantial elevation above the floor. Any activity on a balance beam, particularly by beginning students, inevitably results in falls. With the beam spaced at a height above the floor surface the possibility of injury is significant.

A second problem with the most commonly employed type of balance beam is that it is not easily portable. The common type of balance beam used for gymnastic classes and in gymnastic competition is time consuming to assemble and disassemble, and even in the completely disassembled form is difficult to transport.

The primary objects of this invention are to provide a portable motor skill development low beam that is at a low elevation above the floor surface so as to reduce the possibility of injury to beginning students and to provide a balance beam that is easily transportable from one location to another and is correspondingly easy to assemble or disassemble.

Other features of the portable motor skill development low beam of this disclosure are: (a) improved stability; (b) economy of manufacture and therefore easily affordable by most gymnastic students; (c) improved strength and light weight compared to other known types of balance beams; (d) provision of a balance beam having a low profile; (e) provision of a balance beam that can be assembled in various lengths, such as four feet, eight feet, twelve feet, sixteen feet, etc. at the option of the user; and (f) provision of an apparatus that provides a true beam upper surface for use by the gymnastic student.

SUMMARY OF THE INVENTION

This invention is a portable motor skill development low beam. The beam is formed of an elongated generally flat base member having a bottom surface for resting on a floor and an upper surface. The upper surface has opposed spaced apart substantially continuous short, vertical height ridges. The base member is in the form of a plurality of short lengths, such as a plurality of four foot lengths, that can be assembled end to end to provide the length of the beam required.

The second basic element of the portable motor skill development low beam of this disclosure is an elongated beam member that, in cross-section, is of generally inverted U-shaped configuration. This configuration provides a top portion having a generally planar upper surface and integral, opposed, downwardly extending side portions. Each of the side portions have a lower edge.

The beam member is removably positioned on the base member, with the base member opposed vertical ridges receiving the beam member opposed lower edges. In this manner, the beam member is positionable on the base member and thereby the top portion planar upper surface is supported for use by a student gymnast for the development of motor skills.

The beam member, like the base member, is preferably formed of a plurality of lengths that can be assembled in end-to-end abutted relationship. To assist in retaining the members in assembled form, the abutment of the base member portions and the abutment of the beam member portions are such that the abutments are out of register with each other.

In order to provide an improved upper surface and simultaneously to provide means of removably securing lengths of the beam member in abutted relationship, a fabric is affixed to the upper surface of each of the beam member portions. A length of flexible cover material having fabric hooking elements is removably attachable to the fabric affixed to the beam member portions. In this manner, a long length of cover material having a width equal to that of the beam member upper surface can be affixed to the fabric attached to the upper surface of a plurality of lengths of beam member portions assembled on the base member to thereby retain the balance beam in abutted relationship.

For background material relating to balance beams reference may be had to the following U.S. Pat. Nos. 3,589,716; 3,990,697; 4,105,201; 4,272,073 and 4,448,411.

A better understanding of the invention will be obtained from the following detailed description of the preferred embodiment taken in conjunction with the attached drawings.

DESCRIPTION OF THE PREFERRED EMBODIMENTS

Figure 1:
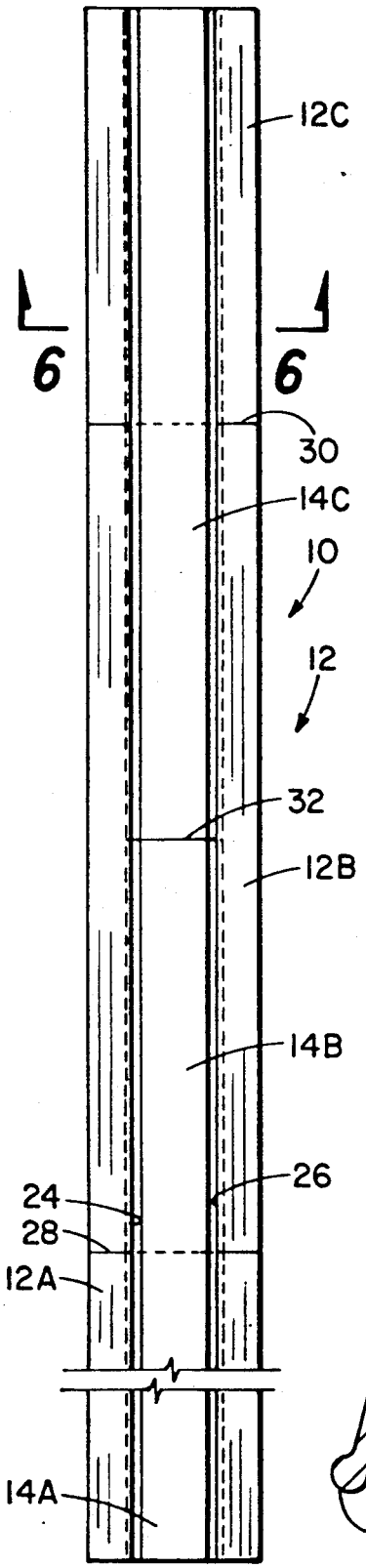
FIG. 1 is a top plan view of a portable motor skill development low beam that incorporates the principles of this invention.
Figure 2:
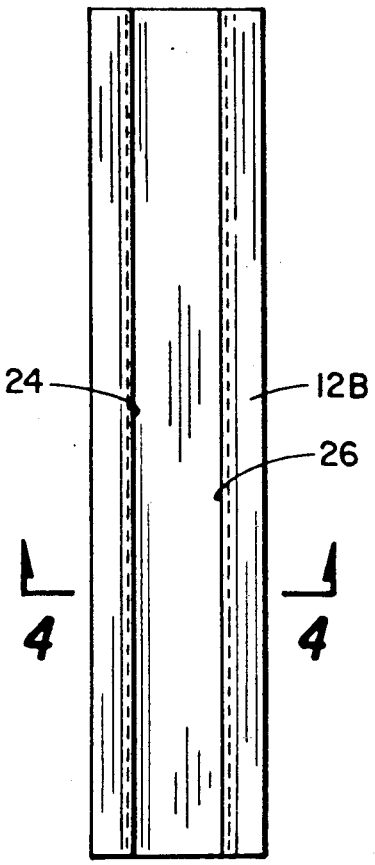
FIG. 2 is a top plan view of the base portion only of the beam.

Referring to the drawings, a top plan view of a motor skill development low beam according to the principles of this invention is indicated generally by the numeral 10 in FIG. 1. The low beam consists of two basic portions, that is, a base member 12 and a beam member 14.

The base member 12 will be first described. Base member 12 is preferably formed of a plurality of relatively short lengths so as to make the low beam of this invention easily transportable. The base member 12 is formed of lengths such as 3 to 6 feet each or may be formed of portions having variable lengths, such as some portions having four feet in length and other portions having two feet in length. FIG. 1 shows three portions designated as 12A, 12B and 12C. Each portion has opposed ends, and the base member 12 is formed by assembling the portions in end-to-end abutted relationship as shown.

Figure 4:
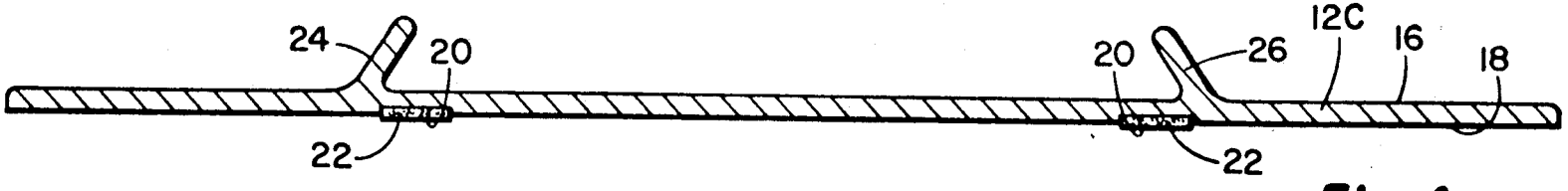
FIG. 4 is a cross-sectional view of the base member as taken along the line 4—4 of FIG. 2.

FIG. 4 shows in enlarged detail a cross-sectional representation of base member portion 12C. Each portion of the base member has an upper surface 16 and a lower surface 18. The lower surface is flat and configured to rest on a support surface, such as on a floor.

Formed in the lower surface are spaced apart longitudinal indentures 20 each of which receives a strip of resilient material 22, such as of natural or synthetic rubber. The function of resilient material 22 is to resist slipping of the base member on the floor which it is positioned.

Upper surface 16 is substantially flat as shown but has two integral spaced apart upstanding, short vertical height ridges 24 and 26. While ridges 24 and 26 may be intermittent or with spaces therebetween, in the illustrated and preferred arrangement, they are continuous and run the full length of each portion making up base member 12.

The base member 12 is preferably manufactured by extrusion of plastic. The type of plastic selected should be that which remains strong and substantially rigid after extrusion.

Figure 3:
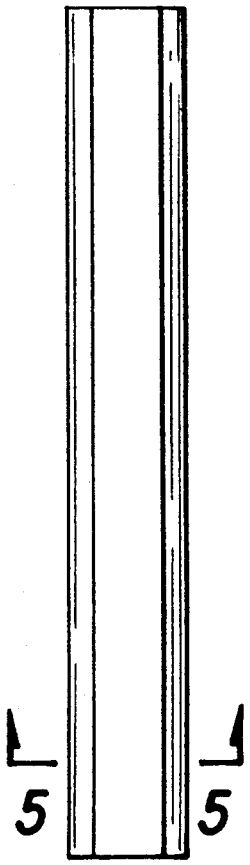
FIG. 3 is a top plan view of a length of the beam portion only of the low beam.
Figure 5:
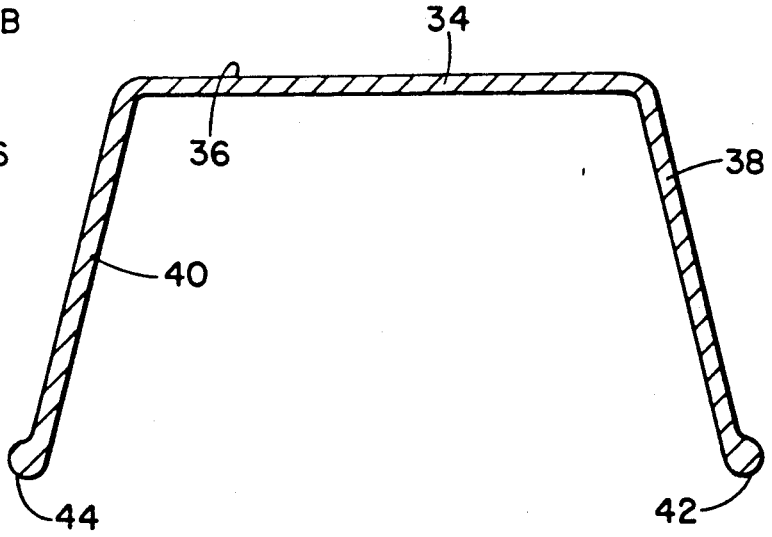
FIG. 5 is a cross-sectional view of the beam member as taken along the line 5—5 of FIG. 3.
Figure 6:
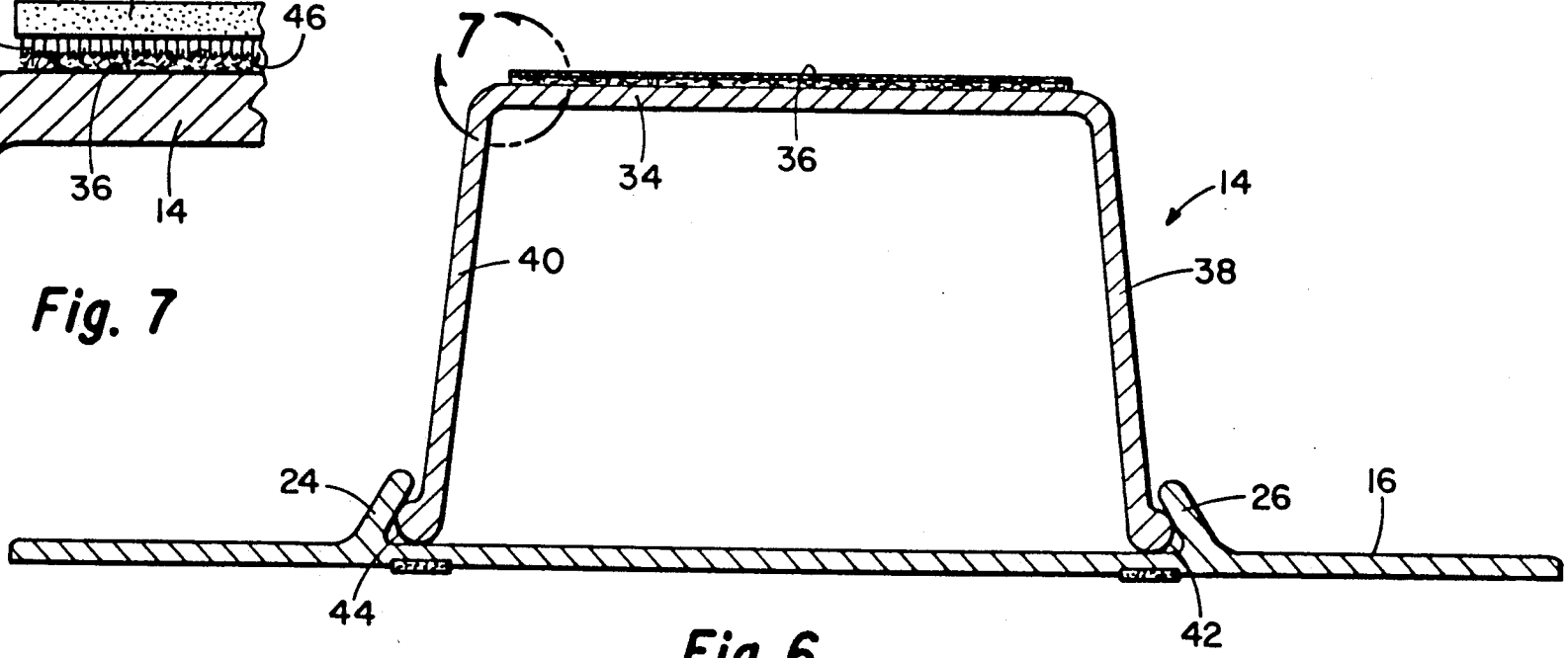
FIG. 6 is a cross-sectional view taken along the line 6—6 of FIG. 1 showing the assembled base member and beam member as arranged for use by a gymnast.

The beam member 14 as shown best in FIGS. 3, 5 and 6, is, like the base member, preferably formed of a plurality of relatively short, easily transportable lengths. In FIG. 1 beam member portions 14A, 14B and 14C are illustrated. The beam member portions are assembled on the base member portions in abutted end-to-end relationship. In FIG. 1 the abutment of base member portions 12A and 12B is shown by line 28. The abutment of base member portions 12B and 12C is shown by line 30. The abutment of beam member portions 14B and 14C is shown by line 32. The beam member 14 is preferably formed of lengths similar to those of the base member portions, such as lengths of four feet, five feet, six feet, etc. The lengths are preferably to make the entire mechanism, when broken into its individual components, easily transportable and it can be seen that the lengths of the base member and the beam member can be of such short length as to fit into the trunk of a standard size car.

FIG. 5 shows the cross-sectional details of a beam member portion. The beam member is preferably extruded of plastic and includes a flat portion 34 having an upper surface 36. The beam member has, extending downwardly from opposite edges of the flat portion 34, side portions 38 and 40 so that the beam member, in cross-section, is of generally inverted U-shaped configuration. The side portion 38 has a lower edge 42 and in like manner, side portion 40 has a lower edge 44. For increased strength the thickness of the side portions is increased at lower edges 42 and 44 as illustrated.

The balance beam is assembled by first laying the base members, such as base member portions 12A, 12B and 12C, in abutted end-to-end relationship on a flat support floor surface. Next, the beam member portions 14A 14B and 14C are positioned on the base member in abutted end-to-end relationship. In order to help maintain the lengths in abutted relationship, the abutment of the beam members should be out of register with the abutment of the base member portions. For instance, as shown in FIG. 1, the abutment 32 of beam member portions 14B and 14C is not in register with either of the abutments 28 or 30 of the base member portions.

As shown in FIG. 6, the beam member is assembled on the base member upper surface 16 with the lower edges 42 and 44 in engagement with the base member integral ridges 26 and 24 respectively. The side portions 38 and 40 of the beam member preferably flare outwardly and downwardly from flat portion 34. This arrangement ensures that as weight is applied to flat portion 34, side portions 38 and 40 will tend to exert increased contact between lower edges 42 and 44 with ridges 24 and 26. Thus, increased weight applied to the beam member intends to increase the security of engagement with the base member.

Figure 7:
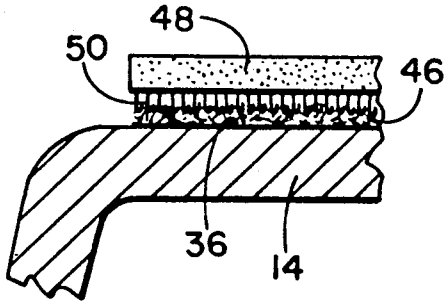
FIG. 7 is an enlarged partial cross-sectional view taken at 7 of FIG. 6 showing details of the use of a fabric for covering the top of the lower beam to provide an improved traction surface and simultaneously to provide means of removably securing the portions of the beam member in abutted end-to-end relationship.

FIGS. 6 and 7 show a means of providing an improved non-slip surface for the beam member 14 and, at the same time, provide improved means of retaining the low beam in assembled relationship. As shown best in the enlarged detailed view of FIG. 7, cemented to upper surface 36 of each beam member portion is a fabric 46. An elongated flexible cover material 48 is provided that has a width substantially equal to that of the beam member flat portion 34 and of a length that is equal to the length of the entire assembled base member portions and beam member portions, as shown in FIG. 1. The flexible cover member may be rolled up when not in use and unrolled during an assembly of the low beam. The flexible cover member 48 has attached to its lower surface fabric hooking elements 50 that removably attach themselves to fabric 46 when contacted with the fabric. Fabric 46 and hooking elements 50 are available on the market under the trademark "VELCRO" and are commonly used for removably attaching elements to each other, such as removable straps on shoes, clothing and so forth. The flexible cover material 48 may be formed of two portions, that is, an upper resilient material that may be such as relatively thin, spongy plastic material and with the fabric hooking elements 50 formed of separate material, the two materials being bonded to each other and when so assembled, remains flexible so as to be easily rolled up to a compact arrangement, but unrolled to apply to the top of the assembled beam member portions.

In setting up the low beam as described herein, the base member portions 12A, 12B, 12C, etc. are assembled for the ultimate length required for the low beam on the floor surface. Next, the beam member portions, such as 14A, 14B and 14C, are positioned on top of the base member portions, being sure that the abutting relationship of the beam member portions do not register with the abutting relationship of the base member portions. Next, fabric 48, having the fabric hooking elements as a part thereof, is unrolled on top of and attached to fabric 46 that is affixed to the upper surface 36 of each of the beam member portions. The entire low beam is then assembled and ready for use. It provides an upper flat surface in exactly the same manner as the balance beam presently used by gymnasts but at a low level so that a total height of the flat beam surface above a floor surface is only 3 to 5 inches, thus substantially reducing the risk of injury in the event of falls. Further, the entire low beam can be very rapidly disassembled into a plurality of easily transportable components. By manufacturing the beam of extruded plastic, it can be at low expense and is extremely durable.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularly, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A portable motor skill development low beam comprising:

an elongated base member having a bottom surface for resting on a support surface and having an upper surface, the upper surface having opposed, spaced apart, paralleled integral upstanding continuous short vertical height ridges an elongated beam member being in cross-section of the length thereof, of generally inverted U-shaped configuration having a top portion having a generally planar upper surface and integral, opposed, downwardly extending side portions that flare outwardly from each other, each side portion having a lower edge, the beam member being removably positionable on said base member, said upstanding ridges receiving said beam member lower edges whereby said beam member is positionable on said base member with said top portion planar upper surface supported for use by a user in the development of motor skills and whereby weight applied to said beam upper surface forces said side portions lower edges into increased locking relationship with said base member upstanding ridges.

2. A portable motor skill development low beam according to claim 1 wherein said base member is formed of a plurality of lengths that may be assembled in end-to-end abutted relationship, and wherein said beam member is formed of a plurality of lengths that may be assembled in end-to-end abutted relationship and wherein the lengths of said base member and said beam member are such that the abutments thereof are out of register with each other.

3. A portable motor skill development low beam according to claim 1 wherein said beam member is formed of a plurality of lengths that may be assembled in end-to-end abutted relationship upon said base member and including means to removably maintain said lengths of said beam member in abutted end-to-end relationship.

4. A portable motor skill development low beam according to claim 1 including:

fabric affixed to said upper surface of each of said beam member lengths and a length of flexible cover material having fabric hooking elements extending therefrom, the cover material being of width substantially equal to the width of said beam member upper surface and of length of said beam member lengths when assembled in abutted end-to-end relationship, the cover material being removably affixable to said fabric to thereby retain said beam member lengths in abutted end-to-end relationship.

5. A portable motor skill development low beam according to claim 4 wherein said length of flexible cover material has an upper and a lower surface, and wherein the lower surface has said fabric hooking elements extending therefrom and the upper surface being cushioned mat-like providing an improved surface to receive the feet of a user.

* * * * *